US011608220B2

(12) United States Patent
Weyrauch

(10) Patent No.: US 11,608,220 B2
(45) Date of Patent: Mar. 21, 2023

(54) INLINER

(71) Applicant: MAUSER-WERKE GMBH, Bruehl (DE)

(72) Inventor: Detlev Weyrauch, Kreuzau-Untermaubach (DE)

(73) Assignee: MAUSER-WERKE GMBH, Bruehl (DE)

( * ) Notice: Subject to any disclaimer, the term of this patent is extended or adjusted under 35 U.S.C. 154(b) by 87 days.

(21) Appl. No.: 16/649,444

(22) PCT Filed: Sep. 22, 2017

(86) PCT No.: PCT/EP2017/001135
§ 371 (c)(1),
(2) Date: Mar. 20, 2020

(87) PCT Pub. No.: WO2019/057265
PCT Pub. Date: Mar. 28, 2019

(65) Prior Publication Data
US 2020/0270044 A1 Aug. 27, 2020

(51) Int. Cl.
*B65D 77/04* (2006.01)
*B65D 77/06* (2006.01)

(52) U.S. Cl.
CPC ..... *B65D 77/0466* (2013.01); *B65D 77/065* (2013.01); *B65D 77/061* (2013.01); *B65D 2231/001* (2013.01); *B65D 2519/00164* (2013.01); *B65D 2519/00273* (2013.01)

(58) Field of Classification Search
CPC .... B65D 77/065; B65D 77/068; B65D 77/06; B65D 77/061; B65D 77/062;
(Continued)

(56) References Cited

U.S. PATENT DOCUMENTS 3,951,295 A * 4/1976 Guenther ..... B65D 77/061 220/592.25
4,635,814 A * 1/1987 Jones ..... B65D 77/06 220/495.04

(Continued)

FOREIGN PATENT DOCUMENTS

DE 4316865 A1 11/1993
DE 202014007695 U1 11/2014
EP 2090528 A1 8/2009

OTHER PUBLICATIONS

International Search Report for International Application No. PCT/EP2017/001135, dated Apr. 26, 2018.

(Continued)

*Primary Examiner* — Robert Poon
(74) *Attorney, Agent, or Firm* — Marshall, Gerstein & Borun LLP

(57) ABSTRACT

Flexible inliner having an upper filling connector and a lower retrieving connector the flexible liner for a pallet container (10) for storing and for transporting liquid and free-flowing filling goods. Each of the filling connector and the retrieving connector is welded to an inliner wall such that film cutting edges are covered in relation to contact with the filling goods, and no film cutting edge, neither the film cutting edge on a welded flange rim of the welded filling connector or the retrieving connector nor the film cutting edge on the internal-side delimitation of a retrieving opening in the inliner wall, comes into contact with the filled liquid filling goods.

8 Claims, 3 Drawing Sheets

(58) Field of Classification Search
CPC ..... B65D 2547/066; B65D 2231/001; B65D 25/42; B65D 25/40; B65D 75/5866; B65D 25/465; B65D 25/48; B65D 5/606; B65D 31/14; B65D 31/142; B65D 31/145; B65D 31/147; B65D 33/01; B65D 83/0055; B65D 83/0061; B65D 2231/002; B65D 2231/004
USPC ..... 206/386; 220/1.6, 9.4, 495.06, 495.01, 220/601, 661, 581
See application file for complete search history.

(56) References Cited

U.S. PATENT DOCUMENTS 5,351,849 A 10/1994 Jagenburg et al.
5,480,057 A * 1/1996 Papaluca ..... B65D 77/065 220/495.06
5,851,072 A * 12/1998 LaFleur ..... B65D 88/1668 383/66
7,861,887 B2 * 1/2011 Ota ..... F17C 1/16 220/581
2011/0000918 A1 * 1/2011 Plunkett ..... B65D 77/06 220/495.06
2016/0016679 A1 * 1/2016 Pereira ..... B31B 70/844 53/469

OTHER PUBLICATIONS

Written Opinion for International Application No. PCT/EP2017/001135, dated Apr. 26, 2018.
IPRP for International Application No. PCT/EP2017/001135, dated Sep. 10, 2019.
English-language translation of IPRP for International Application No. PCT/EP2017/001135, dated Sep. 10, 2019.

* cited by examiner

INLINER

CROSS-REFERENCE TO RELATED APPLICATIONS

This is the US national phase of International Patent Application No. PCT/EP2017/001135, filed Sep. 22, 2017. The entire content of the foregoing application is incorporated herein by reference.

FIELD OF THE DISCLOSURE

The invention relates to a multi-layered flexible inliner having at least one filling/retrieving port for insertion into supporting external containers for storing and for transporting in particular hazardous liquid or free-flowing filling goods.

BACKGROUND

The supporting external containers can be, for example, pallet containers, composite IBCs, flexible IBCs, stiff paperboard/cardboard boxes, bunghole drums, lidded drums, canisters or the like, and serve exclusively for supporting the thin-walled inliner. The liquid filling goods herein do not come into contact with the supporting external container but come into contact only with the interior of the inliner. In order for used and in most cases valuable external containers to be re-used, only a replacement of the used and comparatively cost-effective inliner, or film bag, respectively, is necessary.

Thin-walled inliners of this type are often used in large-volume pallet containers, in particular in cuboid-shaped composite IBCs (hereunder referred to as "IBC" for short), so as to protect the valuable rigid plastics-material internal container in relation to contamination by filling goods, and so as to enable said valuable rigid plastics-material internal container to be re-used. Composite IBCs are composed of a rigid internal container from thermoplastic plastics material, a tubular grid frame which is from horizontal and vertical tubular rods that are welded to one another and as a supporting jacket tightly encloses the plastics-material internal container, and a rectangular base pallet on which the plastics-material container bears and to which the tubular grid frame is fixedly connected.

The rectangular rigid plastics-material container most typically has two longer lateral walls, one shorter rear wall, one shorter front wall, an upper base having a closable filling connector, and a container base, wherein a lower retrieving region having a concave molding which in the shape of a protective housing is directed inward in the direction into the plastics-material internal container and which has a retrieving connector for the protected, recessed fastening of a closable retrieving fitting is provided on the base in the center of the front wall.

Thin-walled inliners which are inserted into a rigid plastics-material internal container are provided with corresponding filling and retrieving connectors which are typically from the same film material as the inliner per se and are connected, or fastened, at the top to the filling connector, and at the bottom to the retrieving connector having a retrieving fitting of the rigid plastics-material internal container of the IBC.

Set of Issues:

When selecting the packaging, for example a pallet container having an inserted multi-layered inliner, for different liquid filling goods, the barrier properties of the inliner that are required for the respective filling good have to be chosen. There are known multi-layered film inliners having barrier layers in the case of which comparatively stiff connectors from a thin-walled plastics material (PE, PA) which are prefabricated by the injection-molding method are welded on, said connectors however not containing any barrier layers and thus not providing any barrier effect. Sensitive liquid filling goods can therefore be influenced and damaged by diffused oxygen, for example.

However, flexible hose connectors from the same film material of the inliner, having a barrier layer, can also be welded about the filling and/or retrieving opening of the inliner. The issue in the case of multi-layered inliners having an asymmetrical film construction then however lies in that in the case of welded film connectors (filling connector and/or retrieving connector) the filling goods will always come into contact with the inner cutting edge of the film opening when welding the film connector flange to the inliner from the outside, or will come into contact with the outer cutting edge of the film connector flange when welding the film connector flange to the inliner from the inside. The adhesive-type bonding agent layers which are incorporated between the barrier layers can be compromised and dissolved in particular in the case of solvent-containing filling goods such that a disadvantageous release of the film layers associated with a loss of the barrier properties can take place in particular in large containers which are equipped with multi-layered inliners and transported over a comparatively long temporal period. The mechanical properties can deteriorate when the film composite is dissolved. Moreover, the filling goods can ingress behind the actual barrier layer and thus circumvent the latter.

Prior Art:

The use of a cuboid inliner from a thin plastics-material film in a rigid plastics-material internal container of a usual pallet container is known from publication EP 2 090 528 A1. The focus herein is in particular the secure fixing of the lower inliner retrieving connector in the rigid retrieving connector of the plastics-material internal container with the aid of the screw-fitted retrieving fitting. The inliner retrieving connector welded to the inliner film wall here is however composed from an annular sleeve having a welded flange rim which is from another plastics material than the inliner film and which is prefabricated by the injection-molding method.

GENERAL DESCRIPTION

Object:

The present invention is based on the object of proposing the design embodiment of a multi-layered inliner having a welded film connector in which the disadvantages mentioned are avoided and the full barrier properties are permanently maintained.

Achievement:

This object is achieved by the special features of patent claim 1. The features in the dependent claims describe further advantageous design embodiment potentials of the inliner according to the invention. The proposed technical teaching conveys in a simple manner how the weak points in a multi-layered inliner can be remedied and the full barrier properties are fully maintained even in the case of long transportation and storage periods of the liquids containers, and diffusion-related damage to sensitive filling goods is avoided. In terms of construction, this is achieved in that the filling/retrieving connector is welded to the inliner wall in such a manner that existing film cutting edges are covered in relation to contact with the filling goods, and no film cutting edge, neither the film cutting edge on the welded flange rim of the welded filling/retrieving connector, nor the film cutting edge on the internal-side delimitation of a retrieving opening in the inliner wall, comes into contact with the filled liquid filling goods.

In one design embodiment of the invention it is provided that the welded filling/retrieving connector is of the same multi-layered film construction as the inliner wall. It is ensured on account thereof that the welded filling/retrieving connectors have the same barrier qualities as the inliner film.

In order for a high strength of the welding of the filling/retrieving connector to the inliner wall having an asymmetrical layered construction to be achieved, the same external film layers are expediently welded to one another.

To this end, the welded flange rim of the filling/retrieving connector is aligned radially inward in a special manner, wherein a through opening which has the same diameter as the retrieving opening in the inliner wall is configured within the welded flange rim. This is achieved in a simple manner in that the filling/retrieving connector by way of the inwardly aligned flange rim is first welded to the closed inliner wall at the envisaged position, and, after the welding of the flange rim, a retrieving opening by means of an annular cutter or a circular punching tool is cut, or punched, respectively, into the inliner wall so as to be centric in relation to the welded filling/retrieving connector, wherein the internal delimitation of the flange rim of the filling/retrieving connector having the same diameter as the retrieving opening in the inliner wall is simultaneously punched or trimmed, respectively, so as to have a clean film cutting edge.

In one further design embodiment of the invention it is provided that the welded filling/retrieving connector is turned inside out and pulled through the retrieving opening in the inliner wall in such a manner that the welded flange rim of the filling/retrieving connector is disposed on the internal side of the inliner wall and the pulled-through filling/retrieving connector is disposed on the external side of the inliner. In terms of production technology it is particularly important herein that the annular welding of the welded flange rim of the filling/retrieving connector to the inliner wall has taken place still prior to the complete and final welding of the blanks of the multi-layered inliner film for the inliner body. To the extent that a tubular film is used as a vertically encircling lateral wall part for the inliner body, said tubular film is turned inside out prior to the welding of the welded flange rim in the shape of an annular disk, and the internal side is turned outside and after the welding of the welded flange rim is again reversed such that the internal side is disposed on the inside again. Thereafter, the filling/retrieving connector which is still protruding inward is likewise turned inside out such that said filling/retrieving connector protrudes toward the outside and is disposed on the external side of the inliner.

In an especially preferred design embodiment of the invention the inliner for insertion into usual 1000 l pallet containers has a cuboid design in which three blanks of a multi-layered inliner film are welded to one another, wherein the said three blanks are composed of an upper horizontal cover part having a centric flexible filling connector, a lower horizontal base part, and a vertically encircling lateral wall part having a flexible retrieving connector on the base. Large-volume pallet containers of this type, in particular composite IBCs, are available worldwide and used in millions for storing and for transporting hazardous liquid or free-flowing filling goods, and by means of the multi-layered inliner according to the invention can be used and rendered useful as a cost-effective multi-application or multi-use packaging means in particular for high-value sensitive liquid filling goods.

In one particular design embodiment of the invention it is provided that the upper centric flexible filling connector of the inliner is fixedly welded into an upper centric filling connector of a rigid plastics-material internal container, and the flexible retrieving connector of the inliner that is disposed on the base is fixedly welded into a retrieving connector disposed on the base of a rigid plastics-material internal container of a pallet container. According to one embodiment herein, the upper centric flexible filling connector and/or the flexible retrieving connector disposed on the base of the inliner are/is fixedly welded so as to be axial on the end side of the upper centric filling connector, or fixedly welded so as to be axial on the end side of the retrieving connector disposed on the base of the rigid plastics-material internal container of the pallet container.

According to one other embodiment, the upper centric flexible filling connector and/or the flexible retrieving connector disposed on the base of the inliner are/is fixedly welded so as to be radial in the external mouth region of the upper centric filling connector, or fixedly welded so as to be radial in the external mouth region of the retrieving connector disposed on the base of the rigid plastics-material internal container of the pallet container. Both welding variants, radial and axial, can of course be combined in an arbitrary manner.

Used containers for the transportation of liquids such as, pallet containers, bunghole drums, and canisters are expertly reconditioned for re-use in qualified reconditioning facilities, this including in particular cleaning, testing, quality control, as well as the insertion of new inliners. When the flexible thin-walled filling and retrieving connectors of the inliner in a pallet container are fixedly welded into the stable filling and retrieving connectors of the rigid plastics-material internal container, said fixing of the inliner in the rigid plastics-material internal container is the easiest to handle for the customers and users, thus the parties filling and emptying the liquid filling goods, because no twisting of the flexible filling and retrieving connectors of the inliner, associated with the formation of creases and leakages, as has often arisen to date in the usual fastening of inliner connectors by way of simple turning inside-out and clamping onto the rigid container connector, can result when screw-fitting and unscrewing screw caps, bunghole connectors, retrieving fittings, or stirring tools.

BRIEF DESCRIPTION OF THE DRAWINGS

The invention will be explained in more detail hereunder by means of an exemplary embodiment which is schematically illustrated in the drawings in which.

DETAILED DESCRIPTION

Figure 1:
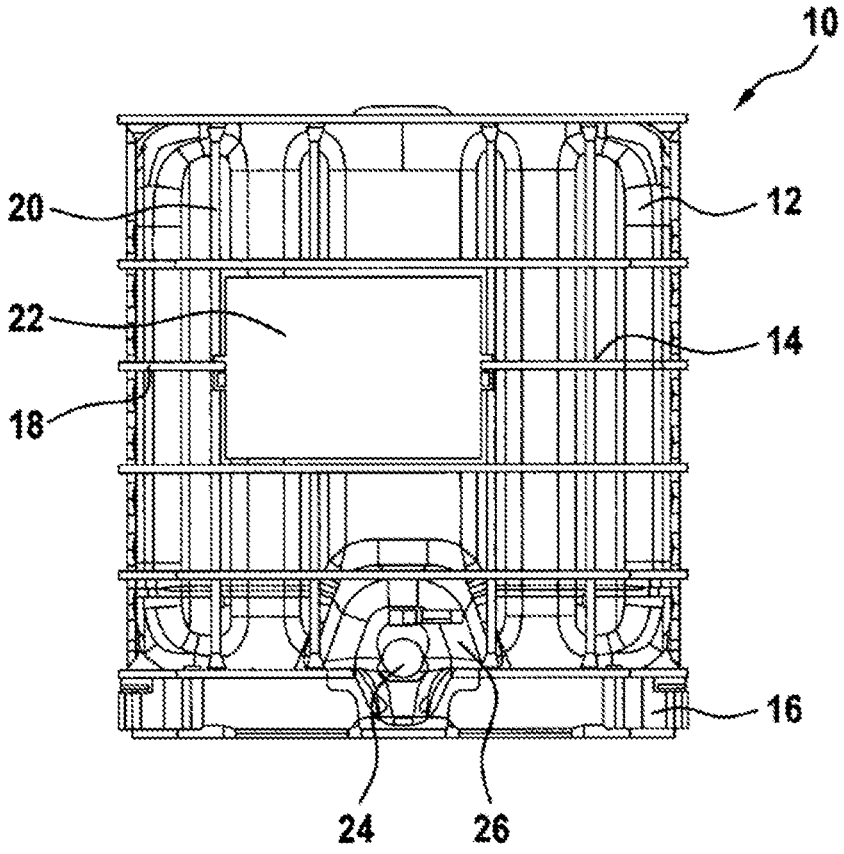
FIG. 1 shows an IBC having an inserted inliner according to the invention, in a front view.

In FIG. 1 a pallet container (IBC) having a filling goods volume of approx. 1000 l for storing and for transporting in particular hazardous liquid or free-flowing filling goods as a preferred exemplary embodiment is identified by the reference sign 10. The pallet container 10 for an application or use, respectively, with hazardous filling goods meets particular test criteria and is provided with a corresponding regulatory permit. The main elements of the pallet container 10 are composed of a thin-walled rigid internal container 12 which is produced from a thermoplastic plastics-material by the blow-molding method, a tubular grid frame 14 which as a supporting jacket tightly encloses the plastics-material internal container 12 and a base pallet 16 on which the plastics-material internal container 12 bears and to which the tubular grid frame 14 is fixedly connected. The external tubular grid frame 14 is composed of horizontal and vertical tubular rods 18, 20 which are welded to one another.

An identification plate 22 from thin steel sheet for identifying the respective liquid filling goods is fastened to the front side of the tubular grid frame 14. A retrieving fitting 24 for retrieving the liquid filling goods is connected on the front of the base of the plastics-material internal container 12. In order for the rigid plastics-material internal container 12 to be protected against contamination by the filling goods filled into said container and for multiple re-use of the valuable internal container to be enabled, a thin-walled inliner 28 according to the invention from a flexible multi-layered composite film is to be inserted in each case into the rigid plastics-material internal container 12 prior to the pallet container 10 being freshly re-filled, said inliner 28 at the top being connected to the filling connector 74 and at the bottom being connected to the retrieving connector 76 of the rigid plastics-material internal container 12.

Figure 2:
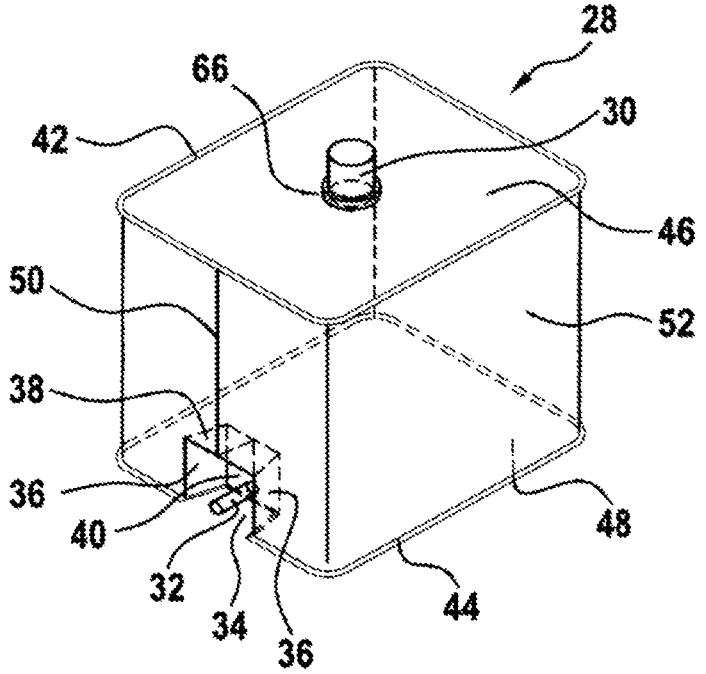
FIG. 2 shows the inserted inliner according to the invention, in a perspective view.

Said flexible inliner 28 according to the present invention, which in this case is likewise cuboid, is schematically illustrated per se (without the enclosing plastics-material internal container 12) in FIG. 2. In contrast to the rigid plastics-material internal container 12 which when handled always remains dimensionally stable in any case, the inliner 28 per se, by virtue of the thin-walled property thereof, is not dimensionally stable but rather flexible, resilient, and adaptable. The wall thickness of the multi-layered inliner composite film is approx. 100 μm to 300 μm, preferably approx. 150 μm. Given a specific area weight of approx. 100 to 150 $g/m^2$, this results in a material weight of approx. 0.7 to 1.3 kg for a 1000 l inliner bag. The inserted inliners are produced from a multi-layered plastics-material composite film having an asymmetrical layered construction. The wafer-thin composite layers herein can be composed of various materials such as, for example HDPE/LDPE/EVOH/PET/PA/PP, or SiOx having layers from a bonding agent disposed therebetween, and/or be provided with a glass-fiber or woven-fabric reinforcement. Depending on the specific application, the composite film is equipped with barrier layers in relation to the diffusion of hydrocarbon, oxygen, aromatic substances, or water vapor, and optionally with antiseptic anti-bacterial coating, or a metal foil which contain vapor depositions of silver or aluminum.

The cuboid flexible inliner 28 in the front lower retrieving region has an inwardly directed wall concavity 34 which corresponds to the concave molding 26 in the shape of a protective housing of the rigid plastics-material internal container 12, having two lateral wall parts 36, one upper wall part 38, and one rearward wall part 40 having a flexible retrieving connector 32 which is molded to the latter and which is configured for bearing in a completely exact fit on the internal surface of the concave molding 26 which in the shape of a protective housing protrudes into the interior of the rigid plastics-material internal container 12. For the sake of improved clarity, this wall concavity 34 of the inliner 28 here is illustrated so as to be very box-shaped. The walls and wall transitions can of course also be configured so as to be heavily radiused, flattened and/or mutually transitioning, but in any case are to be adapted to the respective concave molding 26 in the shape of a protective housing of the rigid plastics-material internal container 12.

In terms of production technology, the body of the flexible inliner 28 is assembled by welding three blanks of a multi-layered composite film having an asymmetrical layered construction. Said three blanks are composed of an upper cover part 46 having the centric flexible filling connector 30, a lower horizontal base part 48 having a recess that corresponds to the shape of the base of the wall concavity 34, and a vertically encircling lateral wall blank 52 having sub-portions in terms of faces for the two lateral wall parts 36, as well as the upper wall part 38 and the rearward wall part 40 of the wall concavity 34 of the inliner 28, as is illustrated in FIG. 2. In the case of a completely produced inliner, the three blanks are welded together by way of two weld seams 42, 44 which are horizontally encircling on the external edge of the upper cover part 46 and on the external edge of the lower base part 48, and for closing the lateral wall blank 52 by way of the weld seam 50 which in the center of the front wall and through the center of the wall concavity 34 runs vertically from the top to the bottom. The particular welding of the flexible filling connector 30 and retrieving connector 32 will be described hereunder.

Figure 3:
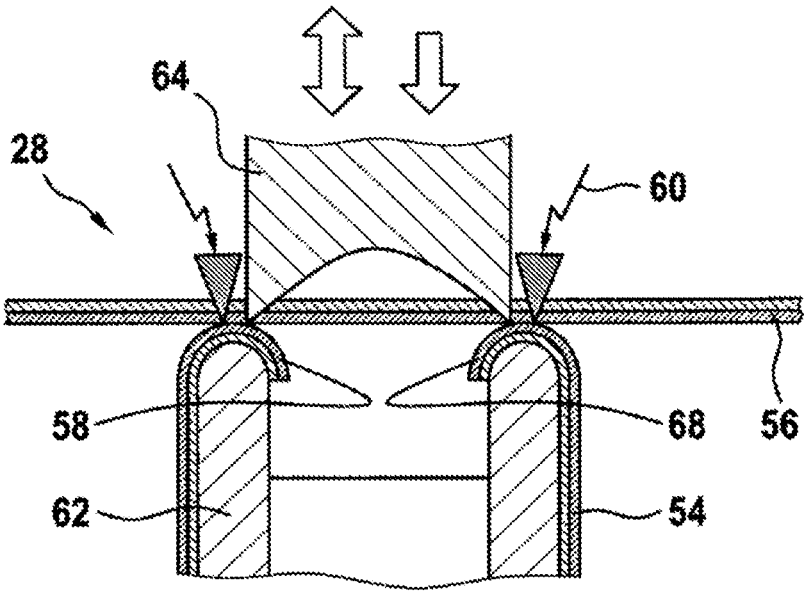
FIG. 3 shows a schematic illustration of a welding and punching device.

The state prior to the welding of a filling/retrieving connector 54 is schematically illustrated by means of a double-layered inliner film ("TwinLiner") in FIG. 3. The two layers of the inliner film are composed of dissimilar materials and thus represent a simple asymmetrical film construction. In an asymmetrical film construction of an inliner film it is important that the same film material, or the same film layer, respectively, of the individual blanks and tubular filling and retrieving connectors are at all times welded to one another. In the case of all parts to be welded, the internal side of the parts which comes into contact with the filling goods is expediently first turned outward. To this end, the blanks, or tubular films, respectively, of the vertical inliner wall as well as the tubular filling/retrieving connector are turned inside out and turned "to the wrong side", so to speak. After the inliner connectors have been welded, all parts are turned back, or reversed, respectively, to their normal positioning.

It is important in this instance that the welded flange rim 58 of the filling/retrieving connector 54 prior to welding is aligned radially inward. The welded flange rim 58 which is aligned radially inward, by means of a pressing tool in the form of a cylindrical counter bearing 62 (this counter bearing can also be referred to as a welding tube), is pressed against the internal side of the inliner wall and welded by means of an annular welding device 60. As the tubular filling/retrieving connector 54 is folded radially inward onto the cylindrical counter bearing 62, thin creases are inevitably formed in the film of the welded flange rim 58, said creases in the subsequent welding of the welded flange rim 58 by way of the annular welding device 60 however being completely ironed out so as to be flat and smooth in relation to the inliner wall. A rib-type reinforcement of the welded area in association with an increased strength of the welded connection is derived on account of the additional film material of the thin creases.

A through opening which is within the welded flange rim 58, 66 and has a clean film cutting edge 68 is configured directly after the welding by means of an annular punching blade 64 which is pushed against the cylindrical counter bearing 62, said through opening having the exact same diameter as the retrieving opening 72 in the inliner wall 56 that is punched, or cut, simultaneously so as to have a clean film cutting edge 70.

Figure 4:
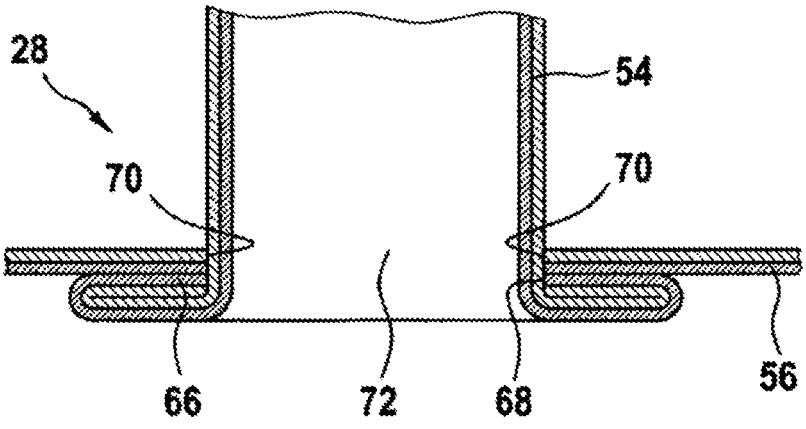
FIG. 4 shows a schematic illustration of a welded inliner connector.

After the welding of the tubular filling/retrieving connector 54, the latter is again "turned inside-out" and pulled through the retrieving opening 72, which has just been cut in the inliner wall 56, to the outside onto the external side of the inliner body, as can be seen in FIG. 4. Here, the external side is illustrated at the top, and the internal side of the inliner body is illustrated at the bottom, as an exemplary embodiment for an upper filling connector of an IBC. In order for the inliner according to the invention to be implemented it is in any case important that the annular welding of the welded flange rim 58 of the filling and retrieving connector 30, 32, 54 to the inliner wall 56 in terms of production technology has taken place prior to the complete and final welding of the blanks of a multi-layered inliner film for the closed inliner body.

Figure 5:
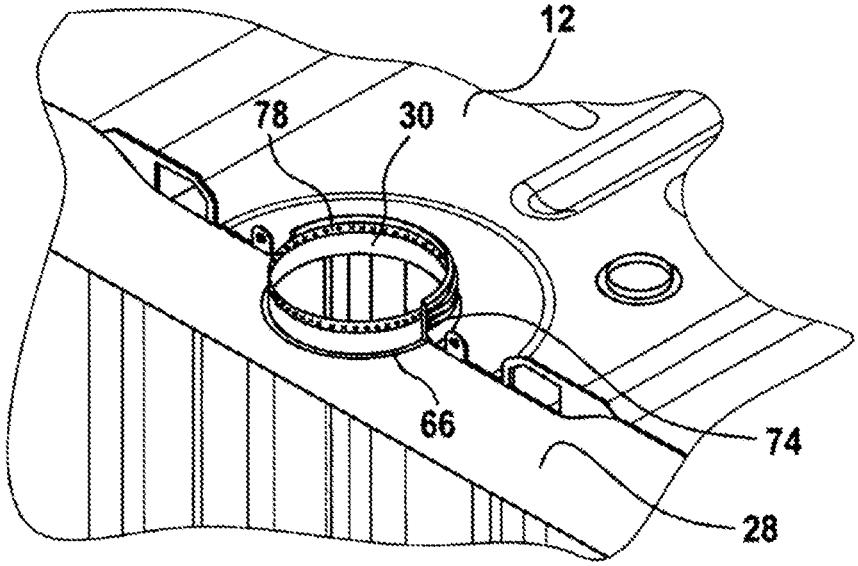
FIG. 5 shows a perspective partial sectional view about the region of an upper filling opening of an IBC plastics-material internal container.

The filling region of the rigid plastics-material internal container 12, having the filling connector 74 molded thereon and the filling connector 30 of the flexible inliner 28 welded thereto, can be seen in a partial sectional illustration in FIG. 5. The flexible filling connector 30 by way of the welded flange ring 66 is welded to the upper side of the inliner 28, on the one hand, and by way of an annular weld seam 78 by radial welding is welded in a rotationally secure manner to the top in the internal side of the rigid filling connector 74 just below the end side of the rigid filling connector 74, said welding being in each case gas-tight and liquid-tight.

Figure 6:
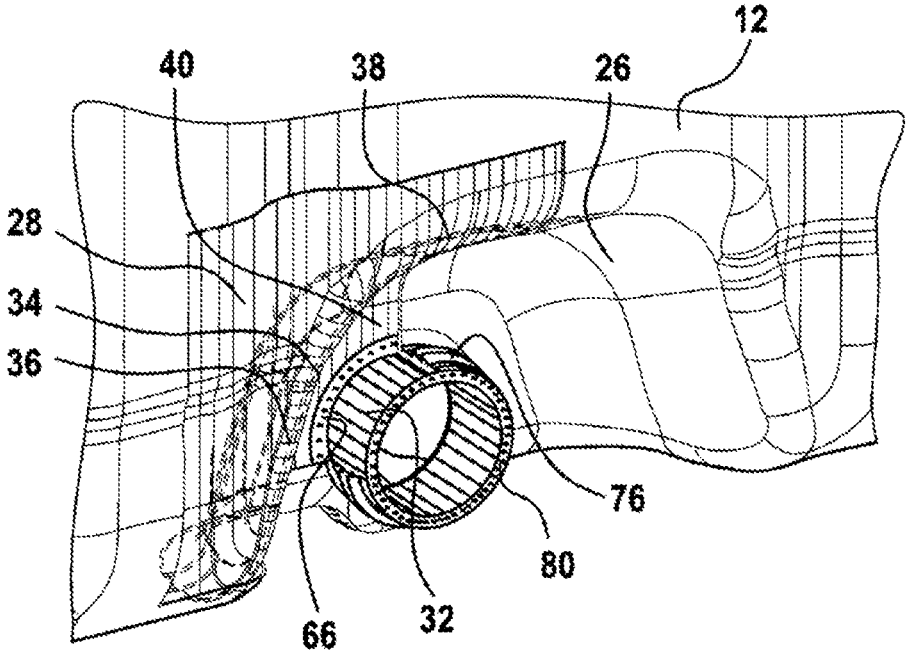
FIG. 6 shows a perspective partial sectional view about the region of a lower retrieving opening of the IBC plastics-material internal container.

Finally, the retrieving region of the plastics-material internal container 12, having the rigid retrieving connector 76 molded thereon and the retrieving connector 32 of the flexible inliner 28 welded thereto at the end side can be seen in a partial sectional illustration in FIG. 6. For improved clarity, a quadrangle has been cut out of the wall of the rigid plastics-material internal container here, wherein the section line runs through the retrieving connector 76, through the protective housing 26 molded therein, and a small piece of the front wall of the plastics-material internal container 12, such that in the cut-out quadrangle the inliner 28 bearing therein by way of a curved wall concavity 34, identified by a multiplicity of vertical lines, can be seen. Furthermore, the obscured left rear part of the wall concavity 34 is indicated by dashed lines. It can be clearly seen in the quadrangular cut-out that the flexible retrieving connector 42 on the inside, or the rear side, respectively, by way of a narrow welded flange rim 66 is welded to the rearward wall part 40 of the wall concavity 34 of the inliner 28, and on the external side by way of an end weld seam 80 by way of axial welding is welded to the end face of the rigid retrieving connector 76, said welding being in each case in a gas-tight and liquid-tight manner. The inliner 28 by way of the shape-adapted wall concavity 34 bears on the full face, like a second skin, on the internal surface of the concave molding 26 of the rigid internal container 12. A substantial advantage of such a second-skin inliner lies in that the film back does not need such a high tear strength in relation to thrashing when being filled, or when the liquid filling goods slosh back and forth in movements during transportation, as to date, since no movement of any kind of the inliner film material takes place because the latter bears in a fixed and permanent manner on the internal side of the plastics-material internal container 12, as if adhesively bonded thereto, so to speak. On account thereof, more cost-effective film materials than to date, which are sensitive to tearing and have high barrier properties, can now also be used.

The upper flexible filling connector 30 as well as the lower flexible retrieving connector 32 of the flexible inliner 28 are expediently produced from the same film material having the same barrier properties as the film material of the flexible inliner 28. However, in the case of the inliner 28 according to the invention, the filling/retrieving connectors 30, 32, 54 are equipped with the same barrier properties as the inliner 28 per se, and disadvantageous diffusion procedures which penetrate the plastics material are precluded. In the case of an asymmetrical film construction of the internal film it is important that the same film material, or the same external film layer, respectively, are in each case welded to one another in the annular welding of the welded flange rim of the filling/retrieving connector to the inliner wall.

Instead of being inserted into the pallet container which has been described in detail and has its peculiarities, the inliner according to the invention, in a correspondingly adapted shape, can of course also be inserted into any other liquids container such as, for example bunghole drums or canisters from steel or plastics material.

Conclusion:

The specific production, or constructive design embodiment, respectively, of an inliner according to the invention advantageously results in a film construction in which no open cutting edges of the multi-layered film point towards the filling goods, and wherein the correct surface is always directed inward. On account thereof, the barrier effect of the multi-layered film when in direct contact with the liquid filling goods is in particular fully preserved even over comparatively long transportation and storage periods, and any disadvantageous influence on or damage to the high-value filling goods by diffusion procedures from the inside to the outside (aromatic substances) or from the outside to the inside (oxygen) through the composite film is avoided on account thereof.

The invention claimed is:

1. A multi-layered flexible inliner composed of a plastics-material film with barrier properties, for insertion into a large volume rigid container, the flexible inliner comprising at least one filling/retrieving connector which is welded to an inliner wall of the flexible inliner and has a welded flange rim, the at least one filling/retrieving connector is likewise composed of plastics-material film, and the flexible inliner is configured for insertion into stable external containers for storing and for transporting hazardous liquid or free-flowing filling goods, wherein the filling/retrieving connector is welded to the inliner wall such that the welded flange rim of the filling/retrieving connector is disposed on an internal side of the inliner wall and a film cutting edge on the welded flange rim of the welded filling/retrieving connector and a film cutting edge on an internal-side delimitation of a retrieving opening in the inliner wall are covered in relation to a contact with liquid filling goods filled thereinto, whereby the welded filling/retrieving connector is of the same multi-layered film construction as the inliner wall, and and the welded filling/retrieving connector is turned inside out and pulled through the retrieving opening in the inliner wall.

2. The inliner as claimed in claim 1, wherein when welding the filling/retrieving connector to the inliner wall, the same external film layers are welded to one another.

3. The inliner as claimed in claim 1, wherein the welded flange rim of the filling/retrieving connector prior to the welding is aligned radially inward, wherein after the welding, a through opening which has approximately the same diameter as the retrieving opening in the inliner wall is configured within the welded flange rim.

4. The inliner as claimed in claim 1, wherein the welded flange rim of the filling/retrieving connector is aligned radially inward and is welded to an internal side of the inliner wall of the multi-layered inliner film by annular welds for an inliner body.

5. The inliner as claimed in claim 1, wherein a cuboid design for insertion into usual 1000 l pallet containers, in which three blanks of a multi-layered inliner film are welded to one another, wherein said three blanks are composed of an upper horizontal cover part having a centric flexible filling connector, a lower horizontal base part, and a vertically encircling lateral wall part having a flexible retrieving connector on the base.

6. The inliner as claimed in claim 1, wherein an upper centric flexible filling connector of the inliner is fixedly welded into an upper centric filling connector of a rigid plastics-material internal container, and the flexible retrieving connector of the inliner that is disposed on a base is fixedly welded into a retrieving connector disposed on the base of a rigid plastics-material internal container of a pallet container.

7. The inliner as claimed in claim 1, wherein an upper centric flexible filling connector and/or a flexible retrieving connector disposed on a base of the inliner are/is fixedly welded so as to be axial on an end side of the upper centric filling connector, or fixedly welded so as to be axial on an end side of the retrieving connector disposed on a base of the rigid plastics-material internal container of the pallet container.

8. The inliner as claimed in claim 1, wherein an upper centric flexible filling connector and/or a flexible retrieving connector disposed on a base of the inliner are/is fixedly welded so as to be radial in an external mouth region of the upper centric filling connector, or fixedly welded so as to be radial in an external mouth region of the retrieving connector disposed on a base of the rigid plastics-material internal container of the pallet container.

* * * * *